United States Patent [19]

Landwehrkamp

[11] Patent Number: 4,932,202

[45] Date of Patent: Jun. 12, 1990

[54] YARN DRAW-OFF PIPE FOR AN OPEN-END SPINNING DEVICE

[76] Inventor: Hans Landwehrkamp, Lilienstrasse 4, 8071 Lenting, Fed. Rep. of Germany

[21] Appl. No.: 377,464

[22] Filed: Jul. 10, 1989

[30] Foreign Application Priority Data

Jul. 16, 1988 [DE] Fed. Rep. of Germany ..... 3824283

[51] Int. Cl.[5] ..... D01H 4/40

[52] U.S. Cl. ..... 57/417; 57/414

[58] Field of Search ..... 57/404, 413–417

[56] References Cited

U.S. PATENT DOCUMENTS 3,875,731 4/1975 Khomyakov et al. ..... 57/417
4,665,687 5/1987 Ott et al. ..... 57/417
4,702,069 10/1987 Maximov et al. ..... 57/417
4,829,762 5/1989 Wassenhoven ..... 57/417
4,843,812 7/1989 Raasch ..... 57/417

*Primary Examiner*—Stuart S. Levy
*Assistant Examiner*—Steven M. duBois

[57] ABSTRACT

In a yarn draw-off pipe (4) for an open-end spinning device a twist stop element (5) is provided, consisting of several wires (50, 51, 52) wound in the same direction and in contact with the circumferential wall of the bore (411). The coils of these wires (50, 51, 52) are in contact with each other. The ends (501, 511) extend outward near the intake opening (43) essentially transversely to the bore axis. The twist stop element (5) is made in form of a replaceable insert.

20 Claims, 2 Drawing Sheets

YARN DRAW-OFF PIPE FOR AN OPEN-END SPINNING DEVICE

BACKGROUND OF THE INVENTION

The instant invention relates to a yarn draw-off pipe for an open-end spinning device with a twist-stop element made up of wound wire in contact with the circumferential wall of the bore.

Providing a twist-stop element in the yarn draw-off pipe in order to produce lightly twisted yarns is disclosed in German Pat. No. DE-2,405,674 C2. Such a twist-stop element is made, as a rule, in the form of a false twist element. The false twist produced is propagated into the point of incorporation, in order to ensure the secure incorporation of fibers despite a relatively low proportion of true twist. To be able to produce such a device, in a simple manner, a helical spring is provided according to the cited art. This spring can, however, be disturbed in its position in the yarn draw-off pipe by irregularities occurring in the yarn, e.g., by thick piecing joints, etc., so that a defined effect is then no longer ensured. Furthermore, it is possible for dirt to accumulate between the individual coils of the helical spring and to be carried off from time to time by the drawn-off yarn and to be incorporated in the yarn, thus producing a faulty spot in the yarn. There is also the danger that the yarn may get caught on the helical spring and tear because of a thick spot, causing the yarn draw-off pipe to become clogged.

SUMMARY OF THE INVENTION

It is the object of the instant invention to design a yarn draw-off pipe that is reliable in operation despite simple construction and that makes it possible to produce lightly twisted yarns.

This object is attained by the invention in a twist-stop element that comprises several wires wound in the same direction, their coils being in contact with each other and their ends extending essentially transversely to the bore axis and outwardly near the intake opening. Since the coils are in contact with each other, no interval is left between them in which fibers and dirt particles can settle. The plurality of wires act intensively on the yarn and act, on the one hand, as a twist stop and, on the other hand, because of their helical coils, as a false twist element, so that lightly twisted yarns can be produced. In addition, the wire ends, which extend outward from the bore and transversely to the bore axis, act as retention elements which temporarily retain the yarn until the latter finally jumps over these wire ends and is thereby lifted off from the deflection edge of the yarn draw-off pipe. Thereby, the twist can propagate itself, unhindered, to the fiber collection surface.

German Pat. Application No. DE-3.619.356 A1 shows how the draw-off nozzle disclosed by German Pat. No. DE 2.405.674 can be improved, but gives no indication concerning the above-mentioned characterizing features of the instant invention.

It has been found to be especially advantageous for the twist-stop element to be provided with four to six wires. However, the effect on the yarn being drawn off can be of varying intensity, depending upon the choice of wires.

It has been found to be particularly advantageous for the wires to be arranged at a gradient angle between 30° and 60° in relation to the circumferential line of the bore, since they are thus able to act especially well upon the yarn.

Since the wires are kept in their relative positions through the fact that they are tightly wound in coils in contact with each other, further measures to hold the wires are practically unnecessary. It is, however, recommended for the wires of the twist-stop element to be glued to each other, as stability is thereby increased.

When the yarn draw-off pipe is equipped with a replaceable inlet part containing the intake opening, the twist-stop element is preferably installed in the inlet part, with the inside diameter in the remaining part of the yarn draw-off pipe being smaller than the inside diameter of the twist-stop element. This ensures that the yarn can be fed back for piecing through the yarn draw-off pipe all the way into the spinning element without any difficulty. No catching on a projecting twist-stop element need be feared.

In a preferred embodiment of the object of the invention, the bore widens near the intake opening of the yarn draw-off pipe and is provided with a ring groove, which is radially open towards the inside, in which the tangential ends of the wires terminate. This ensures that the wire ends will not extend into the path of the yarn where they could roughen up the yarn excessively.

The sections of the wires extending from the bores to the outside lie, preferably, against the face of the intake opening and continue into the end sections which face the yarn draw-off pipe and terminate at a parallel to the bore at a distance from the face of the intake opening. In this manner, the ends of the wires are directed away from the path of the yarn so that the yarn cannot come into contact with the wire ends. The wire ends can terminate in the bores that are at the front of the intake opening. Preferably, however, the wire ends extending parallel to the bore lie against the outside of the part of the yarn draw-off pipe which receives the wires.

The twist-stop element can be secured by different methods inside the yarn draw-off pipe, for example by gluing or through stressing of the wires. The twist-stop element is preferably secured by a ring which can be removed from the rest of the yarn draw-off pipe. This ensures that the yarn slides first over the removable ring, while it is being drawn off, before reaching the area near the radial sections of the wires. On the one hand, this ensures good twist propagation in the direction of the fiber collection surface, and, on the other hand, it prevents excessive roughening up of the yarn.

In order to be able to always use an optimally designed twist-stop element or to dispense with it if necessary, in case of wear or when spinning conditions change, it is appropriately made in form of a replaceable insert.

It has been found that the yarn can be influenced effectively, but nevertheless without harming it, by the twist stop element if the ends of the wires extending from the bore outward are oriented tangentially to the circumferential line of the bore.

The yarn draw-off pipe with multiple wires as the twist-stop element, according to the invention, can be produced easily and cheaply. The twist-stop element functions reliably; there is no, or only minimal, danger that the yarn or thick spots in the yarn or dirt particles carried along by it to adhere to the inner circumference of the twist-stop element.

The invention shall be described in greater detail through several embodiments.

DETAILED DESCRIPTION OF THE INVENTION

Figure 1:
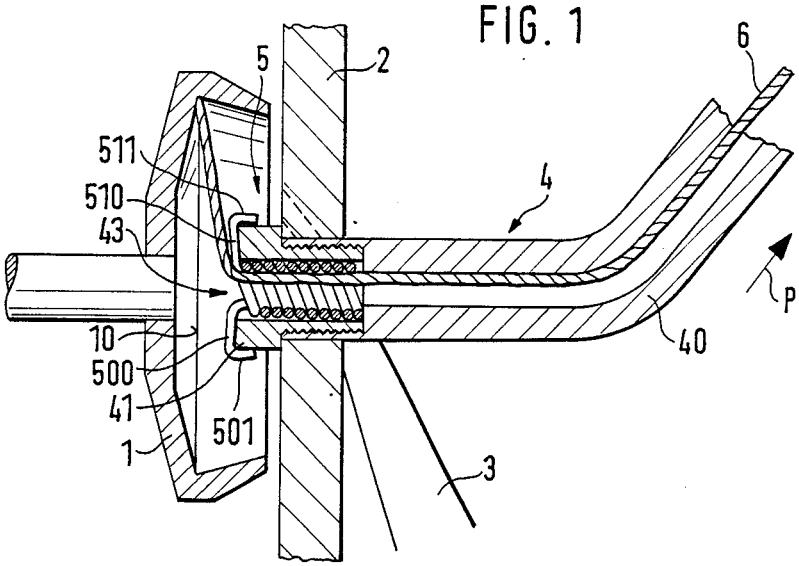
FIG. 1 shows a lateral sectional view of a part of the open-end spinning device with a yarn draw-off pipe designed according to the invention.

According to the embodiment shown in FIG. 1, a spinning rotor 1, installed in a housing (not shown), which is, in turn, covered by a cover 2, serves as the open-end spinning element. Cover 2 contains a fiber feeding channel 3 and a yarn draw-off pipe 4, shown only schematically here, in a known manner.

The yarn draw-off pipe 4 comprises a pipe 40, as well as of an inlet part 41. Both parts, pipe 40 and inlet part 41, are mounted in the cover 2 in a known manner and are suitably connected to each other, e.g., by screwing the inlet part 41 into the pipe 40.

A twist-stop element 5 comprising several wires 50, 51, 52, etc. (see FIG. 2), is located in the inlet part 41. These wires 50, 51, 52, etc., are wound in the same direction in the manner of a screw so that they constitute a kind of pipe. The coils of the adjoining wires 50, 51, 52, etc., are in contact with each other.

The inlet element 41 has a bore 411 in which the twist-stop element 5 is installed, with the wires 50, 51, 52 being in contact with the circumferential wall of the bore 411. The inside diameter $d_1$ of the twist-stop element 5 is greater than the inside diameter $d_2$ of the pipe 40 as seen in FIG. 2.

Figure 2:
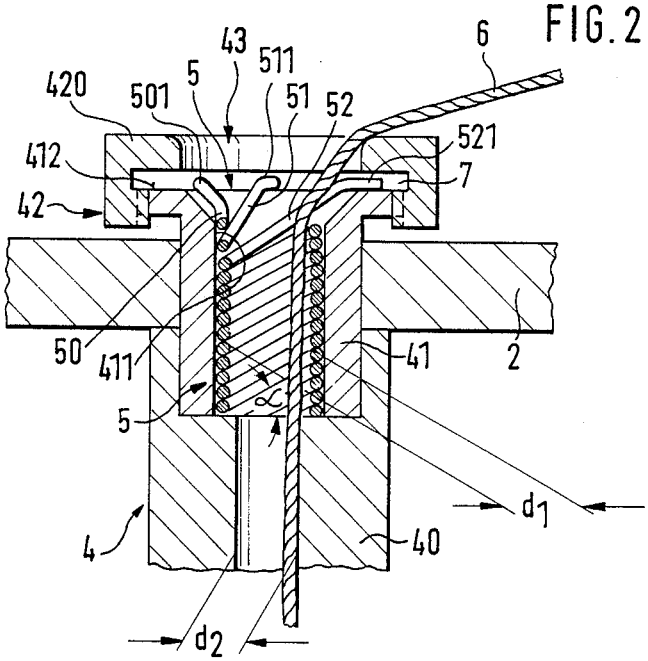
FIG. 2 shows a detailed view of a yarn draw-off pipe facing the open-end spinning device, with a replaceable outlet part.

FIGS. 1 and 2 show a yarn 6 which is drawn off during the spinning operation from the spinning rotor 1 and through the yarn draw-off pipe 4 in the direction of arrow P. In order to start up the spinning process once more, after an interruption, it is necessary to introduce the end of a yarn 6 into the spinning rotor 1 counter to the direction of the arrow P. Due to the fact that the inside diameter $d_2$ is smaller than the inside diameter $d_1$ of the inlet part 41, the end of the back-fed yarn 6 cannot get caught on the ends, at the draw-off side, of the wires 50, 51, 52, etc., which constitute the twist-stop element 5, but reaches the spinning rotor 1 without difficulty.

The twist-stop element 5 does not end with its wires 50, 51, 52, etc., at the end of bore 411 on the side of the rotor but extends, near the intake opening 43, transversely to the bore 411 in front of the bore 411 towards the outside. In order for the ends 501, 511 . . . of the wires 50, 51, 52 . . . to be prevented from extending into the path of the yarn, the wire ends extend parallel to the face 412 of the outlet part 41, so that they are in contact with face 412 in the embodiment shown in FIGS. 1 and 2. At the outer circumference of the outlet part, the wire ends are bent over and end up parallel to the bore 411 or to the outer circumferential surface of outlet part 41 in the direction of the yarn draw-off. Thus, only an intermediate segment 500, 510, etc., of the wires 50, 51, 52, etc., extends into the yarn path so that the yarn 6 being drawn off is not roughened up in its draw-off movement.

During draw-off, spinning rotor 1 imparts a twist to yarn 6, through the end of yarn 6 in production, which rotates with the spinning rotor. This twist, which occurs at the end of the yarn draw-off pipe 4 nearest to the rotor is prevented by the winding constituted by the wires 50, 51, 52, etc., from escaping in the direction of the arrow P. On the contrary, the coils of the wires accumulate the twist in the intake area of yarn draw-off pipe 4. The yarn portion rotating with the spinning rotor 1 comes into contact with the intermediate segments 500, 510 . . . of the wires 50, 51, 52, etc., extending parallel to the face 412 of the outlet part of yarn draw-off pipe 4 and is retained periodically by the wires. The spinning rotor 1, which continues to run, however, causes the yarn 6 to be pulled beyond the intermediate segments 500, 510 . . . The yarn 6 jumps when this occurs and is lifted temporarily from the deflection edge of the inlet part 41. The twist which has previously accumulated in the inlet part can now propagate itself without hindrance into the collection groove 10 of the spinning rotor 1, for as long as the yarn 6 is lifted from the deflection edge. This action is constantly repeated, with the twist always accumulating first in the inlet part 41 and then being reduced. During the running of the yarn 6 it also reels off the inner circumferential surface of the twist-stop element 5. Because of the oblique position of the coils of wires 50, 51, 52, etc., the yarn 6 being drawn off receives a false twist. For this purpose it is necessary for the direction of the rotor circumference and the slant of the coils of the twist-stop element 5 to be coordinated in such manner that the yarn 6, driven by the spinning rotor 1, receives a component in the direction of spinning rotor 1 from the coils of the wires 50, 51, 52, etc.

Figure 5:
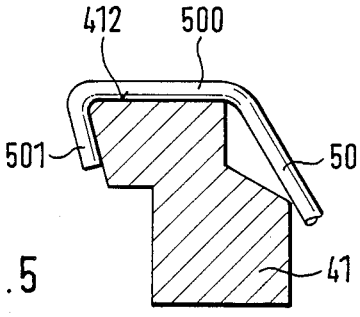
FIG. 5 shows yet another variation of a yarn draw-off pipe designed according to the invention.

According to FIG. 1, the wire ends are secured at the outer circumference of the inlet part 41 where they can be held by an appropriate pre-stress, for example. If necessary, the inlet part 41 can be given a slightly conical shape and widen toward the rotor (as seen in FIG. 2) so that the twist-stop element 5 catches ends 501, 511 . . . of its wires 50, 51, 52, etc., when pushed into and pushed on the inlet part 41 (see FIG. 5).

According to FIG. 2, the wire ends are secured between the face 412 of the inlet part 41 and a ring 42 which can be screwed on the inlet part 41. In this way a ring gap 7 is constituted between ring 42, which has a ring section 420 extending radially inwardly, and the face 412 of the inlet part 41, with the ends 501, 511 . . . of wires 50, 51, 52, etc., extending into ring gap 7. If desired, ends 501, 511 . . . can also be secured by clamping between the inlet part 41 and the ring 42. When the ring 42 is screwed off, the twist-stop element 5 can be replaced if this should become necessary.

Figure 4:
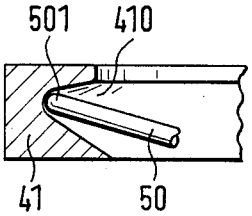
FIG. 4 shows, in cross-section, a detailed view of another embodiment of the invention.

It is not a requirement for this gap 7 to be constituted between the face 412 of the inlet part 41 and ring 42. As shown in FIG. 4, it is also possible to provide a ring groove 410 which is radially open towards the inside in the inlet part 41 which can be formed through lathing for example, and which serves to receive ends 501, 511 . . . of the wires 50, 51, 52, etc. For this purpose the bore 411 becomes wider in the area of the intake opening in order to make room so that the wire ends extend essentially transverse to the bore 411 and outwardly. This also applies in a design in which the ends 501, 511 are held around ring 42 in gap 7 between face 412 and inlet part 41.

Figure 3:
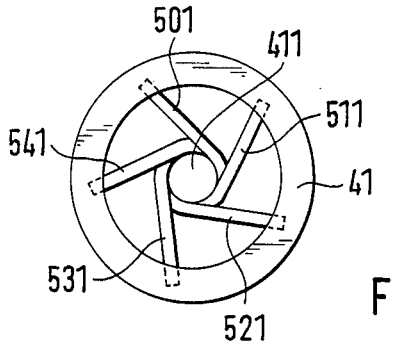
FIG. 3 shows a top view on the intake opening of a yarn draw-off pipe designed according to the invention.

Depending on the desired effect of the twist-stop element 5 upon the yarn 6, the ends 501, 511, 521, 531, 541 . . . of the wires 50, 51, 52 . . . extending outward from the bore 411 can have a position that is oriented, at will, radially to tangentially. FIG. 3 shows a top view of inlet 41 of the yarn draw-off pipe 4 in which the ends 501, 511 . . . extend tangentially to the bore 411 of the yarn draw-off pipe 4 or of the inlet part 41, respectively. The ends 501, 511, 521, 531, 541 . . . are oriented essentially parallel to the yarn position assumed by the yarn 6 on inlet part 41 during its rotation by spinning rotor 1. In this manner, an especially good temporary retention of the rotating yarn 6 is achieved until the latter finally jumps over the wire 50, 51, 52, etc., and is caught again on the next wire while the spinning rotor 1 continues to run. Such an arrangement of the wires ensures good propagation of twist towards the collection groove 10 of the spinning rotor 1.

the mutual contact of the coils of the wires 50, 51, 52 . . . with each other causes them to be fixed in relation to each other in such manner that, in principle, no additional measures are required to secure the relative arrangement of the wires 50, 51, 52 . . . Especially with rougher yarns it can be advantageous for the wires 50, 51, 52, etc., to be glued to each other and thus to be fixed additionally in relation to each other.

The twist-stop element 5 can be secured in different ways in the yarn draw-off pipe 4 of in the inlet part 41, e.g., by means of gluing instead of axial clamping, if the twist-stop element 5 is not to be made in form of a replaceable insert.

The above described yarn draw-off pipe 4 can be altered in many different ways, in particular by replacing certain individual characteristics by equivalent, new combinations thereof. Thus, it is not necessary for the yarn draw-off pipe 4 to be made in two parts and to consist of a pipe 40 and of a separate inlet part 41. It is possible to make the yarn draw-off pipe 4 in one single part. The yarn draw-off pipe 4 can also be bent or angled, and may be provided with more than one twist-stop element 5.

Instead of tapering the inside diameter $d_2$, $d_1$, it is also possible to provide a constant inside diameter of the yarn draw-off pipe 4 and of the twist-stop element 5 or even an inside diameter $d_1$ of the twist-stop element 5 which is smaller than the inside diameter $d_2$ of the yarn draw-off pipe 4, with the inside diameter being compensated at the time of the twist jump in that the end of the twist-stop element 5 furthest from the spinning rotor 1 is adapted to the circumstances by grinding or by covering the wire ends, for instance with an artificial resin, in such manner that the back-feeding of the yarn 6 for piecing is not hindered.

It has been shown that a gradient angle $\alpha$ (FIG. 2) of the wires 50, 51, 52 . . . between 30° and 60° in relation to the circumferential line of the bore 411 is especially advantageous, with this gradient angle $\alpha$ being determined not only by an appropriate selection of the number of wires 50, 51, 52 . . . but also by a corresponding choice of the diameters of these wires 50, 51, 52 . . . A twist-stop element 5 with four to six wires 50, 51, 52 . . . has proven to be especially favorable for the production of false twist (see FIG. 3, in which five wires are provided).

I claim:

1. In an open-end spinning device having an open-end spinning rotor and a cover, a yarn draw-off pipe disposed within said cover for drawing off yarn from said open-end spinning rotor, comprising:

(a) an outlet pipe having a bore for the passage of yarn spun by said rotor and an inlet opening adjacent to said rotor for receiving said yarn; and (b) a twist-stop element comprising a plurality of coiled wires, the coils of each of said wires being interlocked with the coils of at least one other wire, said twist-stop element being disposed in said bore in said inlet opening and including a passageway for said yarn through the coils of said wires, each of said wires having an end which extends substantially transversely to the longitudinal axis of said bore adjacent to said inlet opening.

2. In an open-end spinning device as set forth in claim 1, wherein said twist-stop element comprises at least four wires.

3. In an open-end spinning device as set forth in claim 1, wherein the coils of said wires are arranged at a gradient angle of between 30° and 60° to the circumferential line of said bore.

4. In an open-end spinning device as set forth in claim 1, wherein said wires are glued to each other.

5. In an open-end spinning device as set forth in claim 1, wherein said inlet opening is disposed within in a part of said outlet pipe which is separate from the remaining portion of said outlet pipe, said bore within said replaceable portion having a larger diameter than said bore within the remaining portion of said outlet pipe.

6. In an open-end spinning device as set forth in claim 1, wherein said bore widens in the area of said inlet opening and comprises a ring groove in which the ends of said wires terminate.

7. In an open-end spinning device as set forth in claim 1, wherein a segment of said wires extends from said bore outwardly against a face of said inlet opening.

8. In an open-end spinning device as set forth in claim 7, wherein the ends of said wires extend across said face of said inlet opening to the outside of said yarn draw-off pipe.

9. In an open-end spinning device as set forth in claim 1, wherein said twist-stop element is secured within said inlet opening by a ring which can be removed from the remainder of said yarn draw-off pipe.

10. In an open-end spinning device as set forth in claim 1, wherein said twist-stop element is made in the form of a replaceable insert.

11. In an open-end spinning device as set forth in claim 1, wherein the ends of said wires extend outwardly from said inlet end tangentially to the circumferential line of said bore.

12. An open-end spinning device, comprising:

(a) an open-end spinning rotor;

(b) a cover for said spinning rotor;

(c) a yarn draw-off passage disposed within said cover for guiding yarn spun by said rotor away from said rotor, said passage having an inlet opening adjacent said rotor for receiving said yarn; and (d) a twist-stop element disposed within said inlet opening comprising a plurality of coiled wires, the coils of each of said wires being interlocked with the coils of an adjacent wire, wherein said coils provide a passage for said yarn in said inlet opening.

13. An open-end spinning device as set forth in claim 12, wherein said twist-stop element comprises at least four wires.

14. An open-end spinning device as set forth in claim 12, wherein the coils of said wires are arranged at a gradient angle of between 30° and 60° to the circumferential line of said yarn drawn-off passage within said cover.

15. An open-end spinning device as set forth in claim 12, wherein said coils or wires are glued to each other.

16. An open-end spinning device as set forth in claim 12, wherein said inlet opening and said yarn draw-off passage are disposed within a draw-off pipe and an inlet part which extend through said cover.

17. An open-end spinning device as set forth in claim 16, wherein the inside diameter of said inlet opening is greater than the inside diameter of said draw-off pipe.

18. An open-end spinning device as set forth in claim 12, wherein said yarn draw-off passage widens in the area of said inlet opening.

19. An open-end spinning device as set forth in claim 12, wherein the ends of said wires adjacent to said rotor extend outwardly from said inlet opening substantially transversely of said passage.

20. An open-end spinning device as set forth in claim 12, wherein said twist-stop element is made in the form of a replaceable insert.

* * * * *